US008569602B2

(12) United States Patent
Nash et al.

(10) Patent No.: US 8,569,602 B2
(45) Date of Patent: Oct. 29, 2013

(54) STRINGED MUSICAL INSTRUMENTS AND RELATED METHODS

(76) Inventors: Daniel R. Nash, Stilwell, KS (US); Jason M. Nash, Stilwel, KS (US)

( * ) Notice: Subject to any disclaimer, the term of this patent is extended or adjusted under 35 U.S.C. 154(b) by 288 days.

(21) Appl. No.: 13/087,267

(22) Filed: Apr. 14, 2011

(65) Prior Publication Data

US 2012/0260787 A1 Oct. 18, 2012

(51) Int. Cl.
*G10D 3/00* (2006.01)

(52) U.S. Cl.
USPC ..... 84/291; 84/267

(58) Field of Classification Search
USPC ..... 84/291, 267; D17/16, 20, 21
See application file for complete search history.

(56) References Cited

U.S. PATENT DOCUMENTS

| | | | | |
|---|---|---|---|---|
| 4,178,827 | A | 12/1979 | Mallory | |
| 4,320,685 | A | 3/1982 | Pytlewski | |
| 7,473,831 | B2 | 1/2009 | Cody | |
| 8,217,245 | B1 * | 7/2012 | McKenney | 84/267 |
| 2011/0179937 | A1 * | 7/2011 | Miloslavsky | 84/291 |

* cited by examiner

*Primary Examiner* — Jianchun Qin
(74) *Attorney, Agent, or Firm* — John K. Buche; Buche & Associates, P.C.

(57) ABSTRACT

Improvements in acoustical and stringed musical instruments (e.g., guitars) are disclosed.

13 Claims, 4 Drawing Sheets

STRINGED MUSICAL INSTRUMENTS AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This specification discloses improvements in acoustical and electrical stringed musical instruments (e.g., guitars).

2. Background

Musical instruments are used to produce sounds. Sound may be a mechanical wave transmitted through a compressible medium at a frequency within the range of hearing. A hearing-frequency vibrating wave may be produced in air via vibrating a surface. Accordingly, musical instruments have employed vibrating surfaces as a means for producing sound.

Stringed musical instruments utilize the vibrating surface of tautly suspended and plucked strings to produce sound. However, a vibrating string, by itself, may not be entirely satisfactory for producing music since: (a) the volume-level of sound resulting from a vibrating surface is generally dependant on the quantities of vibrating surface areas and the resultant wave's energy (larger vibrating surfaces and energies result in greater volume levels); (b) strings typically possess small surface areas and low wave energies; and (c) situations exist that require loud music. Accordingly, stringed musical instruments employ means for increasing vibrational surface areas and wave energies of strings so that louder sounds result.

To produce louder sound in a stringed musical instrument, the surface area of vibration of a string may be increased by mechanically coupling the string to a resonance plate or sound board. Said mechanical connection results in the sound board vibrating at the same frequency as the string. Guitars, for example, have strings that are coupled to a sound board via a bridge and saddle (one known guitar features two sound boards mechanically coupled to each other to increase the vibrating surface area (U.S. Pat. No. 7,473,831 (issued Jan. 6, 2009))). However, increasing the surface area of vibration of a string via a sound board(s), alone, is not entirely satisfactory for increasing sound volume in stringed instruments since the requisite mechanical connection correspondingly dampens the vibrational energy. For this reason, stringed musical instruments also employ means for increasing the vibrational energies of strings so that louder sounds result.

The vibrational energy of a plucked string mechanically coupled to a sound board and the energy of the resulting sound wave may be increased via resonance. To with, most stringed instruments feature a sound board that is coupled to a resonance chamber (e.g., a sound box). Operably, the resonance chamber of a stringed instrument receives a mechanical wave resulting from a vibrating string and continuously reflects the wave internally so that it is reinforced and amplified as the string continues to vibrate. As a result, the wave propagates an increased energy which correspondingly increases the sound volume of the instrument. Although useful for increasing the sound volume of a stringed instrument, a resonance chamber does not efficiently increase the volume of sound produced by a vibrating string since the sound wave to be resonated by the chamber is dampened during transmission from the string to the chamber. In view of said dampening transmission, there is a need for apparatus and methods that increase the efficiency of sound wave transmission from a vibrating string to a resonance chamber.

Some have attempted to meet the above identified need by affixing additional vibratable elements to the resonance plate and within the resonance chamber of the instrument. For example: U.S. Pat. No. 7,473,831 (issued Jan. 6, 2009) discloses a guitar with a second sound board within its resonance chamber; U.S. Pat. No. 4,320,685 (issued Mar. 23, 1982) discloses a guitar with a sloped sound board wherein the strings are coupled to a bridge on the topside of the sound board; and, U.S. Pat. No. 4,178,827 (issued Dec. 18, 1979) discloses a guitar with fins or vanes that extend from the underside of its sound board to within its sound box. These items may not be entirely satisfactory, however, for increasing the efficiency of sound wave transmission from a vibrating string to a resonance chamber because affixing additional vibratable elements to a resonance plate will correspondingly increase the dampening of sound producing vibrations. Thus, a need continues to exist for apparatus and methods for improved sound wave transmission from a vibrating string to a resonance chamber in a musical instrument.

SUMMARY OF THE INVENTION

An object of this application, among others not explicitly stated, is to disclose apparatus and methods that increase the efficiency of mechanical wave transmission through air from a vibrating string to within a resonant chamber. More specifically, an object of this patent application is to disclose a stringed musical instrument structured so that mechanical waves produced by plucking its strings are more efficiently transmitted to its sound box. The stringed musical instrument disclosed in this application may comprise: at least one string that is suspended through a surface of a resonance plate, wherein the string and said surface have an oblique incidence. Described differently, the musical instrument disclosed in this application may comprise: at least one tautly suspended string; a sound board; and a sound box defined on one side by said sound board so that the underside of the sound board is internal to said sound box; and, wherein at least a portion of said string vibrates within said sound box when plucked.

BRIEF DESCRIPTION OF THE FIGURES

The manner in which these objectives and other desirable characteristics can be obtained is better explained in the following description and attached figures in which.

Figure 1:
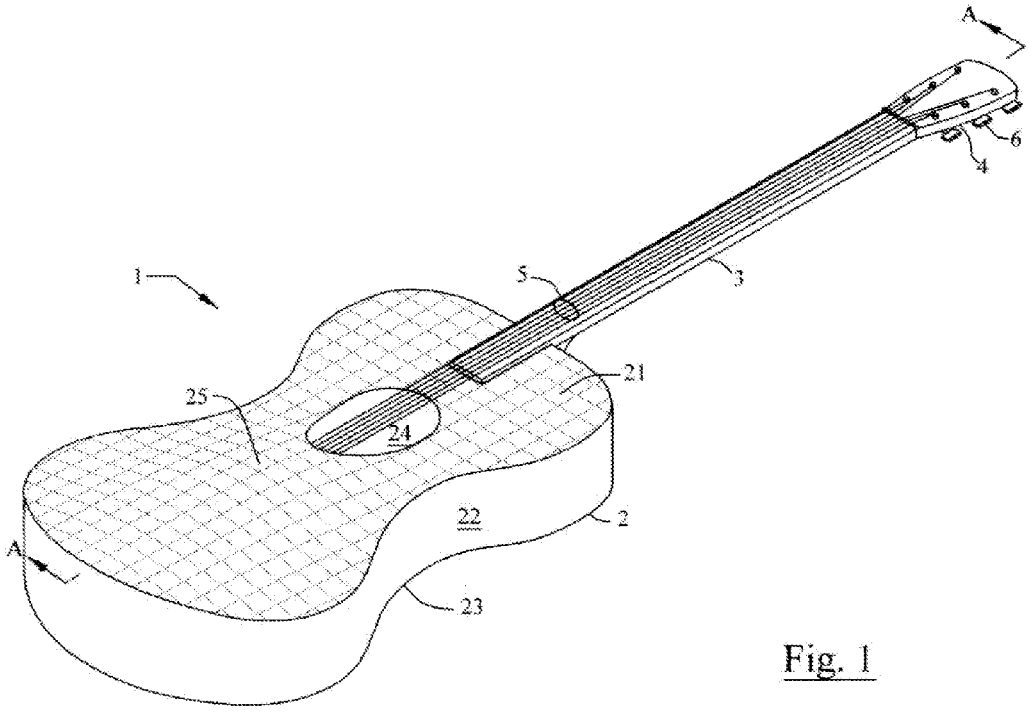
FIG. 1 is a perspective view of an instrument 1.

It is to be noted, however, that the appended figures illustrate only typical embodiments disclosed in this application, and therefore, are not to be considered limiting of its scope, for the invention may admit to other equally effective embodiments that will be appreciated by those reasonably skilled in the relevant arts. The components in the figures are not necessarily to scale, with an emphasis instead being placed upon illustrating the principles of the invention. In the figures, like reference numerals designate corresponding parts throughout the different views.

DETAILED DESCRIPTION OF PREFERRED EMBODIMENTS

In general, this application discloses a stringed musical instrument with efficient mechanical wave transmission through air between its plucked string and resonance chamber. The disclosed stringed instrument may comprise at least one string, a sound board (resonance plate), and a resonant chamber that is partially defined by the sound board. Suitably the string is mechanically coupled to the sound board so that a portion of the string is positioned within the resonance chamber. To accomplish placement of a portion of the string inside the resonance chamber, the string may be suspended through a surface of the resonance plate, wherein the string passes the plate at an oblique incidence to at least one surface thereof. A full and detailed description of the disclosed musical instrument is best made with reference to the accompanying drawings.

Figure 8:
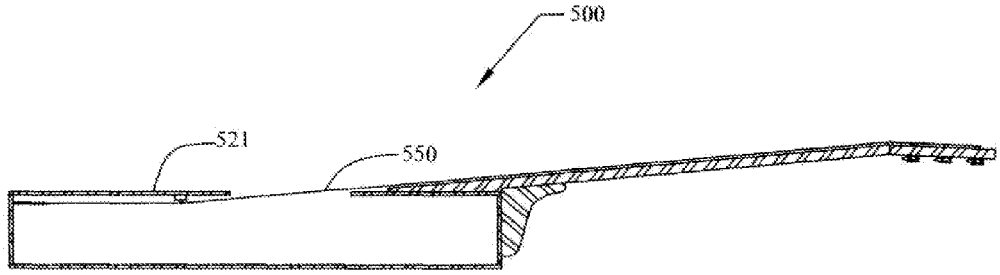
FIG. 8 is a cross section of another instrument 500.

FIG. 1 is a perspective view of a stringed musical instrument 1. As can be seen in the figure the instrument 1 preferably comprises a body 2, a neck 3, a head stock 4, and at least one string 5. The body 2 is preferably defined by: (1) a sound board 21 with a sound hole 24 and an obliquely contoured surface 25 (i.e., the surface of the sound board 21 generally defines a plane and features a portion that is oblique to the general plane (the figure has contour lines to show obliqueness in the form of a bulge or bowe)): (2) a sound box 22; and (3) a guitar back 23. Suitably, the neck 3 may be joined to the top of the body 2 and may, in some embodiments, partially overlay the sound board 21 and be supported by a neck-joint (also known as a neck heel). The head stock 4 may be positioned at the end of the neck 3 furthest from the body 2 and suitably features a nut at the joint thereof. Preferably, at least one string(s) 5 may be suspended over the neck 3 from the headstock 4 and through the sound hole 24 to, as discussed in greater detail below, a mechanical connection within the soundbox 22. The string(s) 5 may be tautened between said mechanical connection to the sound board 21 and the nut of the headstock 4 (via, e.g., the tuning elements 6) so that at least a portion of the string(s) 5 is suspended through the sound hole 24 and so that at least a second portion of the string(s) is suspended at a level that is beneath a level of a top surface of the sound board 21 (e.g., internal to the body) (it should be noted that said first and second string portions may be the same or different portions of the string(s) 5). Said positioning of the portions of the string 5 may result even where strings 5 are suspended paralell to the general plane of the resonant plate 21 since the sound hole 24 occupies a portion of the oblique surface 25. Alternatively, as seen in FIG. 8, said positioning could be accomplished by applying an oblique incidence to the suspended string 550 relative to the general plane of the sound board 521 rather than, as shown in FIG. 2, positioning an oblique surface 25 with an opening 24 on the sound board 21.

Figure 2:
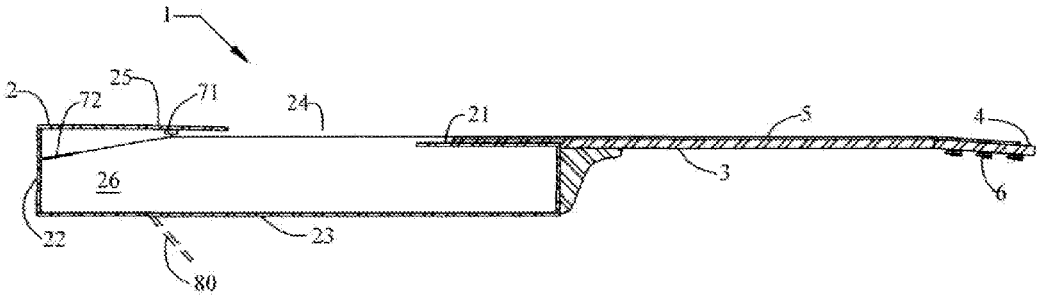
FIG. 2 is a cross section of the instrument depicted in FIG. 1.

FIG. 2 is a cross section of the stringed instrument 1 along the line A of FIG. 1. The figure depicts the inside 26 of the body 2, including the suspension of the at least one string(s) 5 over the neck 3 from the headstock 4 nut, through the sound hole 24, and to a mechanical connection 72 on the inside 26 of the body 2. Suitably, the sound board may feature at least one surface 25 that is suitably oblique relative to the general plane of the sound board 21 and which surface 25 is partially occupied by the sound hole 24 so that the at least one string may be suspended within the body 26 without interference from a top surface of the sound board 21. The instrument 1 may also feature a bridge 71, bridge-like attachment, or some other attachment to the sound board 21 so that the at least one string(s) 5, when plucked, may transfer any resultant vibrations to the sound board 24. The instrument may further feature a saddle or some other means for holding the string 5 off of the bridge 71. It should be noted that the instrument may be acoustic or electric (via electrical components 80 known to those of skill in the art of electrical stringed instruments).

Figure 3:
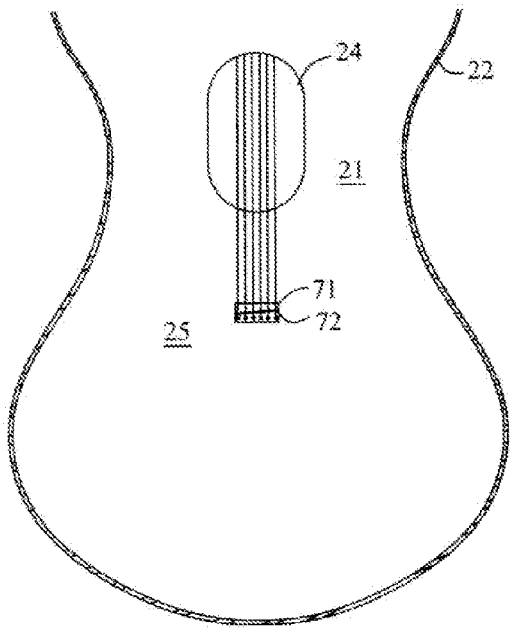
FIG. 3 is view of an alternative embodiment of a sound board for a musical instrument.

Still referring to FIG. 2, the location of the mechanical connection 72 and bridge 71 may vary depending on the type of stringed instrument and desired sound quality. For example, the bridge 71 and connection 72 may be split or have an integral bridge 71 plus connection 72 structure. FIG. 2 depicts a preferable location for the connection 72 inside 26 the body 2 at a wall of the soundbox 22 and the bridge 71 on the underside of the soundboard 21. For comparison purposes, FIG. 3 depicts the underside of an alternate embodiment of the sound board 21 with the string 5 mechanically connected 72 to a undersurface of the oblique surface (bulge or bowe) 25 at the same or similar location of a bridge 71. Furthermore, although both FIGS. 2 and 3 depict the connection 72 and the bridge 71 as inside 26 the instrument 1, it is possible that the connection 72 or bridge 71 or structures thereof may be external to the body 2, with the contact point of the string 5 to bridge 71 being at a level that is beneath a level of a top surface of the sound board 21 (e.g., internal 26 to the body 2). The orientation and support of the bridge 71 plus connection 72 (FIG. 3) structure or bridge 71 and connection 71 (FIG. 2) structures may be of any geometry and the strings 5 may terminate at the bridge/saddle structure, bridge structure, tail piece or in any other manner. As alluded to above, the bridge 71 or connection 72 may feature a saddle or saddle-like structure.

Figure 4:
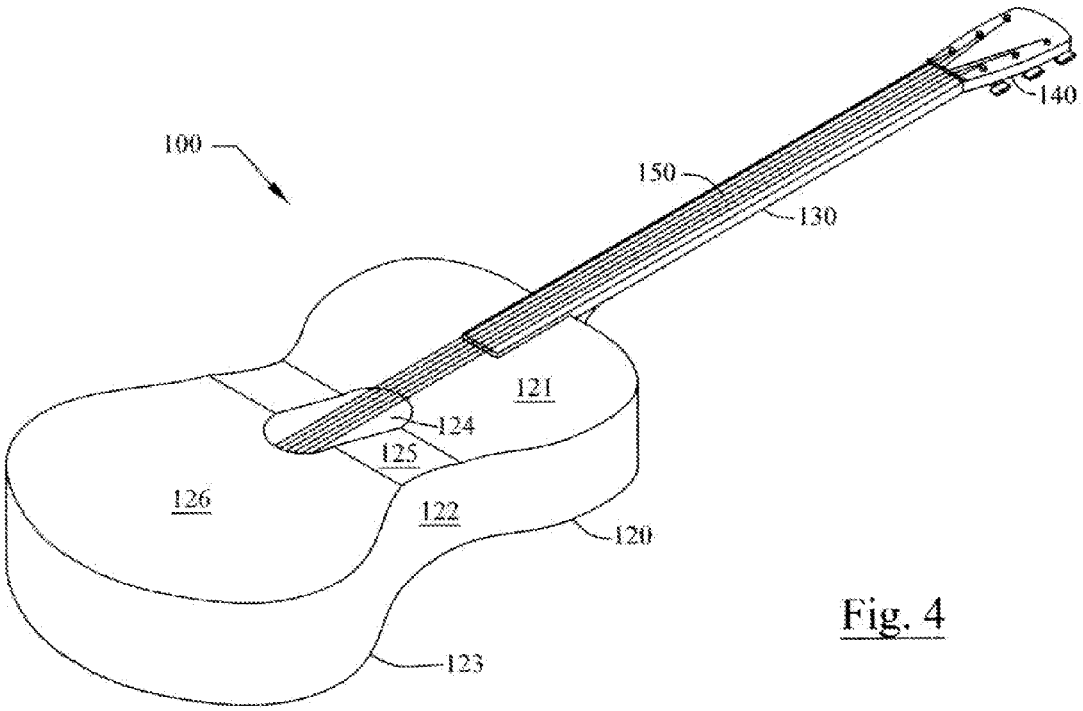
FIG. 4 is another instrument 100.

FIG. 4 is perspective view of another preferable embodiment of a stringed instrument 100. As can be seen in the figure the instrument 100 preferably comprises a body 120, a neck 130, a head stock 140, and at least one string 150 which generally and respectively correspond to the body 2, neck 3, head stock 4, and at least one string 5 of the instrument 1 depicted in FIGS. 1 and 2. The body 120 is preferably defined by: (1) a sound board 121 with a sound hole 124, an oblique surface 125, and a top surface 126; (2) a sound box 122; and (3) a guitar back 123.

The structures and functions of the various features of the preferred instrument 100 embodiment of FIG. 4 generally mirror the corresponding structures and functions of the earlier disclosed instrument 1 of FIG. 2. For instance, the instrument 100, like the earlier disclosed instrument 1, preferably features at least one string(s) 150 that may be tautened between a mechanical connection to the sound board 121 and the nut of the headstock 140 so that at least a portion of the string(s) 150 is suspended over and through the sound hole 124 so that at least a second portion of the string(s) 150 is suspended at a level that is beneath a level of a top surface of the sound board 126 (e.g., internal to the body). As with the earlier embodiment, said positioning of the strings 150 may be accomplished in part by placing the sound hole 124 on a portion of the oblique surface 125. A primary difference between the instrument 100 of FIG. 4 and the instrument 1 of FIGS. 1 and 2 may be the ornamental appearance of the soundboards 121 and 21.

Figure 5:
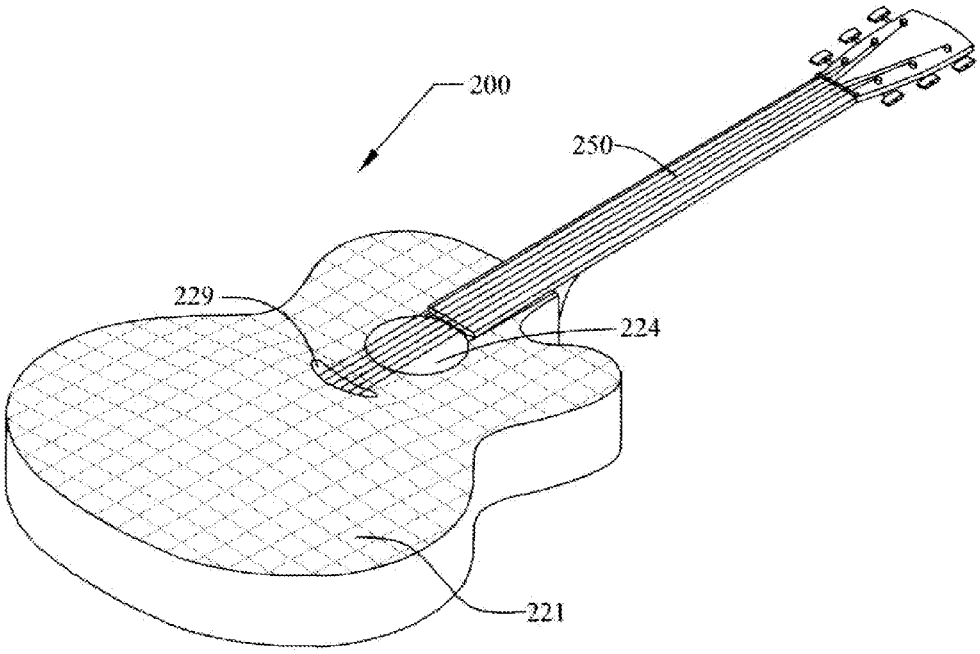
FIG. 5 is a view of another alternative embodiment of a sound board for a musical instrument.
Figure 6:
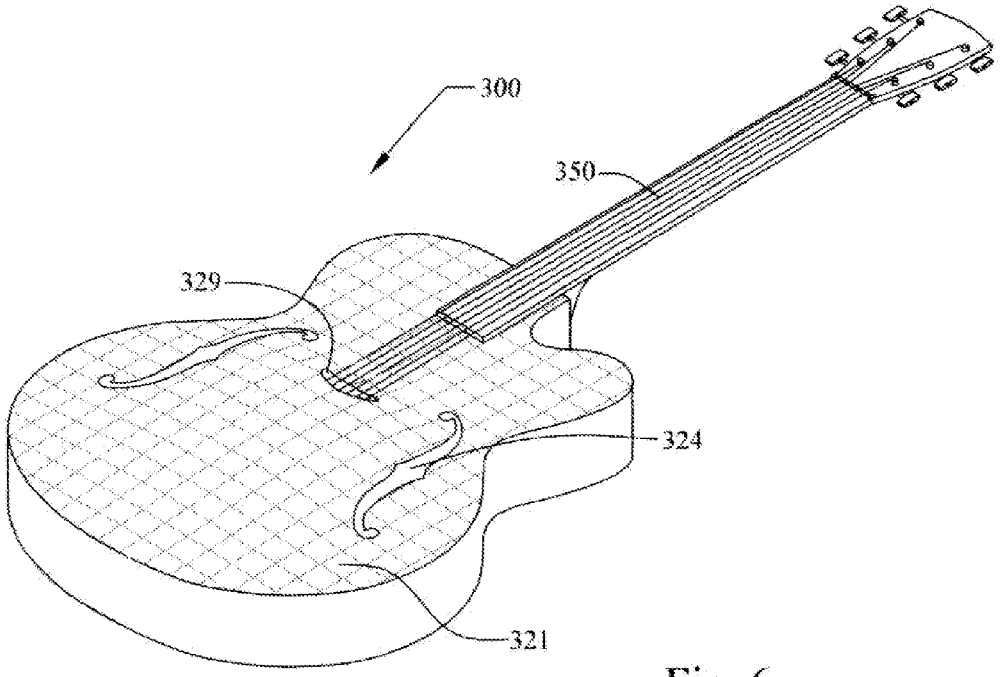
FIG. 6 is a view of yet another alternative embodiment of a sound board for a musical instrument.

FIGS. 5 and 6 are perspective views of alternate embodiments of stringed instruments 200 (FIG. 5) and 300 (FIG. 6). As with the earlier embodiments, the sound boards 221 and 321 feature a bulge, bowe, or other non-zero sloped surface adjacent to a opening 229 and 329 in an oblique surface of the soundboard 221 and 321 so that strings 250 or 350 may be connected with the contact point of the string to bridge (see, e.g., the connection of the string(s) 5 with the bridge 71 in FIG. 2). Preferably, said string and bridge connection may be at a level that is beneath a level of a top surface of the sound board 221 or 321 (e.g., internal 26 to the body 2 (see FIG. 2)). However, in the embodiments depicted in FIGS. 5 and 6 the openings 229 and 329 are independent of, and in addition to, more traditional shaped sound holes 224 and 324.

Figure 7:
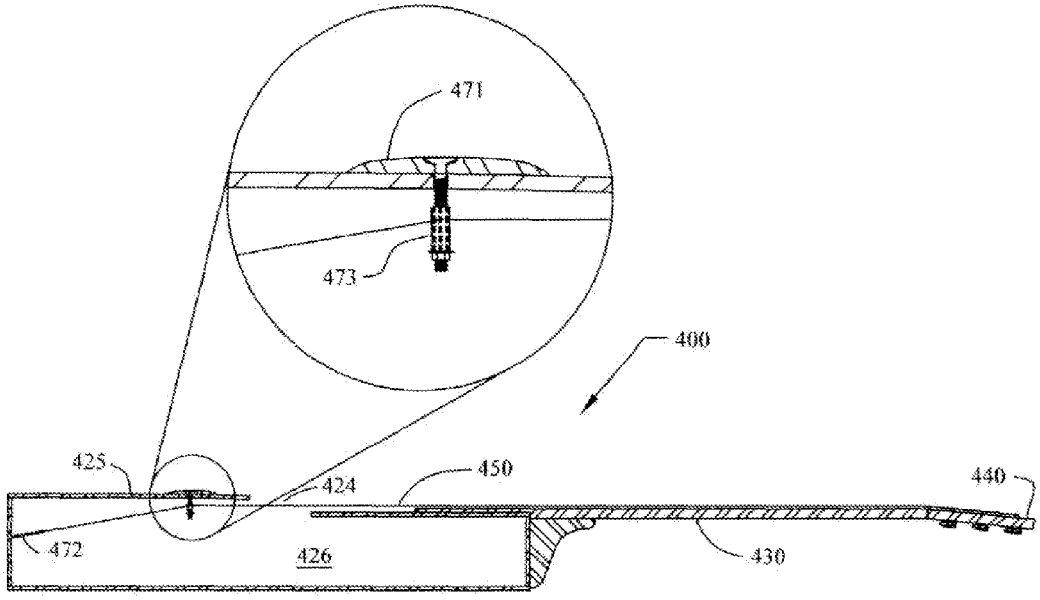
FIG. 7 is a cross section of yet another instrument 400.

FIG. 7 depicts a cross-section of another embodiment of a musical instrument 400. The figure depicts the inside 426 of the instruments sound box (similar to FIG. 2), including the suspension of at least one string 450 over a kneck 430 fropm the headstoc 440 nut, through the sound hole 424, and to a saddle 473. Suitably, the saddle 473 is suspended beneath the sound board 425 (i.e., within the sound box 426) via a bridge 471 that is installed on the top surface of the soundboard 425 (i.e., external to the sound box 426). Stated differently, the figure depicts an alternative embodiment of the instrument 400 wherein the saddle 473 may be split from the bridge 471.

Those of skill in the art will know well or readily ascertain the methods by which a musical instrument and related components have been historically constructed, designed, and prepared. Those of skill in the art will also know materials that may be suitable for stringed instrument uses, including acoustics.

Although preferable embodiments have been disclosed with particular ornamental appearances, it should be noted that the functional and conceptual principles disclosed in this application may be applied to any variety of stringed musical instruments without departing principles' spirit and intent. For instance, what is disclosed may be a musical instrument comprising: a body that defines a resonance chamber and that features a resonance plate; and, a bridge that is affixed to the resonance plate, the resonance plate configured so that the affixed bridge may mechanically connect to a string with at least a portion of the string being located within the resonance chamber. What is disclosed may also be resonance plate comprising: a surface; a first portion of said surface that is oblique relative to a second portion of said surface; and, an opening through said surface that is located, at least in part, on said oblique portion. Yet still this specification may disclose a method of installing a string on a musical instrument with a resonant chamber, the method comprising the steps of: affixing a first end of the string to the musical instrument at a first location that is not within the resonant chamber; and affixing a second end of the string to the musical instrument at a second location so that at least a portion of the string suspends within the resonant chamber. In other words, the musical instrument embodiments disclosed in this application are for illustrative purposes and, therefore, should not be viewed as limiting the scope of this application beyond what is claimed.

We claim:

1. A musical instrument comprising:

a body that defines a resonance chamber and that features a soundboard with a sound hole; and, a bridge that is affixed to the soundboard, the soundboard configured so that the affixed bridge is mechanically connected to a string that extends through the sound hole with at least a portion of the string being located within the resonance chamber, wherein the bridge is affixed to an underside of the soundboard inside the resonance chamber.

2. The musical instrument of claim 1 wherein said configuration of the soundboard is a surface thereof that is oblique relative to another surface thereof and that is positioned adjacent to an opening in the resonance chamber.

3. The musical instrument of claim 2 wherein said oblique surface is a bulge in the soundboard.

4. The musical instrument of claim 2 wherein the bridge is affixed to oblique surface of the soundboard.

5. The musical instrument of claim 1 further comprising: a neck with a plane; and, wherein said configuration of the resonance plate is a surface thereof that is oblique to the plane of the neck and an opening in the soundboard.

6. The musical instrument of claim 5 wherein the bridge is affixed to the oblique surface of the soundboard.

7. A method of installing a string on a musical instrument with a resonant chamber that features a soundboard with a sound hole, the method comprising the steps of:

affixing a first end of the string to the musical instrument at a first location that is not within the resonant chamber;

affixing a second end of the string to the musical instrument at a second location so that at least a portion of the string suspends through the sound hole to within the resonant chamber; and affixing a bridge to the soundboard, the soundboard configured so that the bridge is mechanically connected to said string, wherein the bridge is affixed to an underside of the soundboard inside the resonance chamber.

8. The method of claim 7 wherein said second location is on the soundboard.

9. The method of claim 8 wherein:

the musical instrument features a neck that extends from said resonant chamber to a headstock; and, the first location is on the headstock.

10. The method of claim 9 wherein the neck is oblique relative to the resonant plate.

11. The method of claim 8 wherein:

the soundboard features a surface thereof that is oblique relative to another surface thereof and that is positioned adjacent to an opening in the resonance chamber; and, the second location is on the underside oblique surface.

12. The method of claim 11 further comprising the step of threading the string through the opening in the resonance chamber.

13. The method of claim 11 wherein the oblique surface is a bulge.

* * * * *